United States Patent [19]

Hopkins et al.

[11] Patent Number: 4,926,548

[45] Date of Patent: May 22, 1990

[54] SELECT SOLDER SLOT TERMINATION METHOD

[75] Inventors: John R. Hopkins, Hummelstown; Randy M. Manning, New Cumberland, both of Pa.; Stephen A. Marusak, New Port Richey, Fla.

[73] Assignee: AMP Incorporated, Harrisburg, Pa.

[21] Appl. No.: 212,119

[22] Filed: Jun. 27, 1988

Related U.S. Application Data

[62] Division of Ser. No. 661,744, Oct. 17, 1984, abandoned.

[51] Int. Cl.[5] ..... H01R 9/08

[52] U.S. Cl. ..... 29/860; 29/866

[58] Field of Search ..... 29/842, 843, 844, 845, 29/855, 857, 860, 861, 865, 866

[56] References Cited

U.S. PATENT DOCUMENTS

| | | | |
|---|---|---|---|
| 3,002,176 | 9/1961 | Yopp | 339/176 |
| 3,770,874 | 11/1973 | Krieger et al. | 339/275 B |
| 3,895,852 | 7/1975 | Wasserlein, Jr. | 339/99 R |
| 3,905,665 | 9/1975 | Lynch et al. | 339/275 B |
| 4,035,050 | 7/1977 | Volinskie | 339/99 R |
| 4,040,705 | 8/1977 | Huber | 339/99 R |
| 4,047,785 | 9/1977 | Jayne | 339/99 R |

OTHER PUBLICATIONS

IBM Bulletin, "Chip Connector", vol. 7, No. 8, 1/65, Schneider et al.

AMP Inc. Advertisement, *Electronics*, 9/11/72, p. 172.

*Primary Examiner*—Timothy V. Eley

*Attorney, Agent, or Firm*—Robert W. Pitts

[57] ABSTRACT

A method and terminal for mass terminating conductors with high reliability combines insulation piercing and solder technology. Terminals are formed with insulation piercing, conductor engaging portions which have a layer of solder integral therewith. Respective conductors are terminated by the terminals in an insulation piercing operation and the solder reflowed to form a permanent bond therebetween. The terminal slot is designed to clean the conductor surface as well as to fixture it for the solder reflow operation.

1 Claim, 6 Drawing Sheets

SELECT SOLDER SLOT TERMINATION METHOD

This application is a Divisional of Application Ser. No. 661,744 filed Oct. 17, 1984, now abandoned.

BACKGROUND OF THE INVENTION

1. The Field of Invention

The present invention relates to a method and product for terminating electrical conductors and in particular to a method and product which combine insulation piercing and solder technology.

2. The Prior Art

There are many acceptable ways to join electrical conductors to electrical terminals including soldering, crimping, brazing, welding and, in the last decade, a method generally referred to an insulation displacement, commonly referred to as IDC for insulation displacement connection. Each of these techniques has its place according to parameters of material cost, cost of the labor for effecting the joint and according to the resulting reliability, all in the context of a given environment of use. Put more directly, one can take less care and spend less on interconnecting wires to drive displays or motors in toys that sell for less than a day's pay than one might for like components used in a space shuttle where not only a fortune is at stake, but life itself.

In general, the bulk of electrical terminations have been made by soldering and crimping with IDC now becoming more widely used because of productivity improvement implicit in the technique. The advantages of solder include a potential for excellent reliability and low cost, when performed properly and employed in large volume production utilizing sophisticated soldering equipment where the solder process can be controlled rather exactly and the parts can be readily designed to fit the process. When neither the geometry of the parts can be controlled nor high volume exists to underwrite volume production equipment, hand soldering can be and is widely utilized. It is there that the five variables in soldering become most critical and sensitive to variability. These five include having the right solder, the right cleanliness of surfaces to be soldered, the right fixturing to hold things still, the right pressure on the parts for heat transfer and the right amount of heat or dwell time of heat application. In the article "Soldering Technology—A Decade of Developments," *International Metals Review,* 1984, Volume 29, Number 2, by C. J. Thwaites, all of the foregoing aspects are mentioned in some detail with as thorough a bibliography as one is likely to find, though in citing this useful article it must be stated that not all of the 449 cited references have been studied.

When one or more of the above discussed five critical requirements for a good solder joint vary too much, trouble will surely follow. For example, when one uses the wrong solder relative to the surface of the metal or geometry of the parts to be soldered, all sorts of problems can occur—the solder will not wick well or wet to the surfaces, potential corrosion due to the electrical disparity of metals may result, the solder will not bond well and so forth. If the wrong flux is used to clean the surfaces to be soldered, poor joints are almost inevitable. Acid fluxes, suitable for plumbing, can literally eat up the relatively fragile parts used for electronic components. Totally neutral acids, which may be preferred for the foregoing reasons, may not break through the surface oxides intrinsic to the metal surfaces of the parts or those oxides developed in time by the environment and duration of inventory. A case of nerves and the resulting jitter, while solder is liquid, can easily spoil a solder joint and, of course, too much heat will also do so. Pores and fractures in a solder joint evidence an over application of heat caused by sudden out gassing. Lumpy appearance and cold joints evidence too little heat. In pot or wave solder baths, surface dross can and does plague all operations. An accidental introduction of organics, or build up in time of such ingredients to brighten solder, can cause dewetting, voiding, oxidation, and poor appearance problems. In a word, bad chemistry, bad metallurgy, bad practices all can limit solder as an electrical connection medium.

The art of crimping is usually performed by pressure application, in a tool, on a portion of a metal terminal to inelastically deform such about a bare electrical wire. The terminal/tool system assures excellent terminal/-wire joints repeatedly with little skill required. Crimping typically takes a great deal of energy and even with small wires/terminal crimps can demand 70 to 100 inch-pounds of work with die forces frequently exceeding 1000 to 1500 pounds. Larger sizes of terminal/wire indeed require forces of many thousands of pounds. Moreover, crimping usually calls for precision displacement of dies to effect the necessary deformation and tolerances between 0.001 and 0.003 inches are not uncommon. Thus high force and close tolerance characterizes most quality crimps. As can be appreciated, high forces and close tolerances mean precision die surfaces and precision tool linkages which inescapeably means cost. Additionally, high forces call for tooling dies that are quite strong and capable of bearing repeated forces and frictional engagements of the metal deformation of terminals. That fact dictates a certain size limitation, width and height, beef, if you will, limiting how close terminals may be fixed in connectors and still be crimped by practical dies. It limits how many wires can be crimped simultaneously without having to have a multi-ton force mechanism such as a press. In a word, high force, precision and size of crimping dies all act as major recognized limitations on crimping as a termination technology. For a more complete understanding of the foregoing, reference is made to the following text: "Physical Design of Electrical Systems," Volume III, *Integrated Devices in Connection Technology,* Chapter 10; authored by members of The Bell Telephone Laboratories, copyright 1971 Prentiss Hall Inc., Englewood Cliffs, N.J.

The concept of IDC involves stuffing an insulated wire into a slot in a metal portion of a terminal. It has evolved in two ways for separate reasons. An early use of IDC is shown in Patent #3,320,354 to J. E. Marley issued May 16, 1967. There, insulation displacement was employed to essentially effect stripping so as to handle very small solid wires where removal of insulation proved difficult and time consuming. A second aspect of IDC relates to the situation where, by the use of insulation displacement, improved productivity could be obtained due to the fact that relatively large multiples of wires could be terminated simultaneously, essentially because the forces of termination are relatively low, being measured in the tens of pounds for wire gauges on the order of 18 to 26 AWG, rather than in hundreds of pounds or thousands of pounds as in the case of crimp technology. Reference may be made to U.S. Pat. No. 3,012,219 to E. J. Levin et al issued Dec. 5, 1961, for a description of this latter type of IDC use.

In fact, IDC use has been more spurred by increased productivity than by merely its advantage in stripping insulation. Productivity improvements utilizing IDC have resulted in labor cost reductions per termination on the order of 50 to 70 percent, particularly where the IDC concept is employed in pre-loaded multiple connectors.

The main problem with IDC is a perception that what goes in easily comes out easily. Despite efforts to ally this perception by fixes with metal or plastic insulation gripping structures, many users have refrained from employing IDC technology. The success and reliability of proven solder and crimp technology has, to some extent, intimidated the use of IDC concepts.

For a good overall understanding of the IDC technology, reference is made to AMP incorporated publication HB5351, revision B, "Introduction of AMP Insulation Displacement Techniques and Products" published by AMP Incorporated, copyright 1976, 1979 by Arlen Crandall.

In summary, solder can be an excellent electrical terminal terminating technique but one must control the five critical factors or else suffer bad joints, crimp works well with little skill but takes high forces and precision tooling and is limited in center-to-center application and for multiple wire applications; and IDC gives productivity increases and self stripping but can come apart if one can pull or push the wire out of the slot that is the basis of the technology.

SUMMARY OF THE PRESENT INVENTION

The present invention gains the benefits of solder while building in control of the five critical parameters of soldering technology and at the same time gains the benefits of IDC in terms of self-stripping and mass termination for high productivity; all with an excellent termination of electrical conductors and particularly of wires to terminals.

An object of the invention is to provide a better way to terminate wires, cables and multiple electrical conductors through automatic stripping, cleaning, fixturing, solder placement and force application as to the interfaces which are intended to be joined by solder reflow.

A further object is to provide an article, method, and product process which embraces joining electrically conductive elements through the use of heat to reflow solder and solder-like substances.

In essence, the present invention embraces providing an electrical terminal, which includes at least one slotted portion to receive an insulated wire with the slot dimensioned to strip away insulation and/or oxides or other films from the wire surfaces and the surfaces of the terminal, and holding and fixturing such wire while heat is applied to the slotted portions to cause solder or solder-like substances proximate to the slot to melt and flow around the wire and the slotted portion to provide a joint of terminal and wire. The solder is placed on the terminal as a coating or skin in a thickness to provide just the right amount to affect a proper joint. It has been discovered that the combinations of a slot having edges and a wire stuffed therein operates reliably to cause wicking of the melting solder toward the slot wire contract area. Whether this is by capillary, meniscus, surface tension, some combination thereof or by other means is not thoroughly understood—suffice to say it happens repeatedly and regularly given a slot defined by punched metal, a wire dimensioned to be scrubbed when stuffed in the slot and the known practices of the art of soldering. The "right amount" of solder is enough to surround the wire at the site of the contact of the slot edges of the terminal and not so much as to drip or bridge out from the termination area. The dimensions of the slot relative to the wire should be enough to strip and clean the engaged surfaces thereof and the material of the terminal defining the slot must be thick enough, relative to its hardness, to do all the work of stripping, cleaning and fixturing.

As a further major aspect of the invention, it has been discovered that eddy current heating, as by induction, results in "internal" heat which can cause a melting and pull back of insulation away from the slot prior to actual solder reflow, at least with certain foamed types of insulation. This provides less potential for contamination of the solder, wire, and slot area.

DESCRIPTION OF THE PREFERRED EMBODIMENTS

Figure 1:
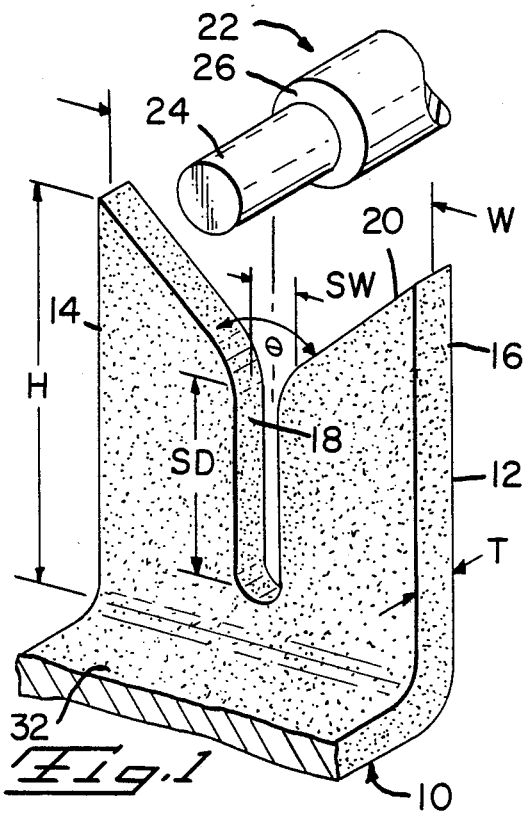
FIG. 1 is a perspective view of one form of the invention showing a slotted portion of a terminal with an electrical wire poised for insertion.

The detailed description of the present invention is made with reference to FIGS. 1–4A. FIG. 1 shows a conductor engaging portion of an electrical terminal 10 formed by an upstanding plate portion 12 defining a pair of sharp tines 14, 16 with a slot 18 therebetween and a tapering entry 20 leading to the slot. The terminal can be of any known type, such as that described in U.S. Pat. No. 4,040,704, the disclosure of which is incorporated herein by reference. An electrical wire 22, formed by a conductor 24 covered by an insulative layer 26, is poised above slot 18. The end of the wire 22 has been stripped of the insulation 26 so that the conductor 24 is bare. In this particular illustration the conductor 24 is a solid copper conductor suitably tin plated in accordance with practice in the art of wire manufacture.

Figure 2:
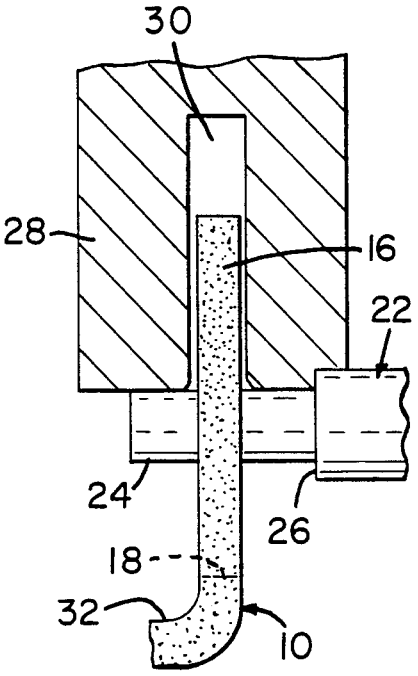
FIG. 2 is a side elevation of the structure of FIG. 1 showing the wire being inserted into the slot by a tool.
Figure 3:
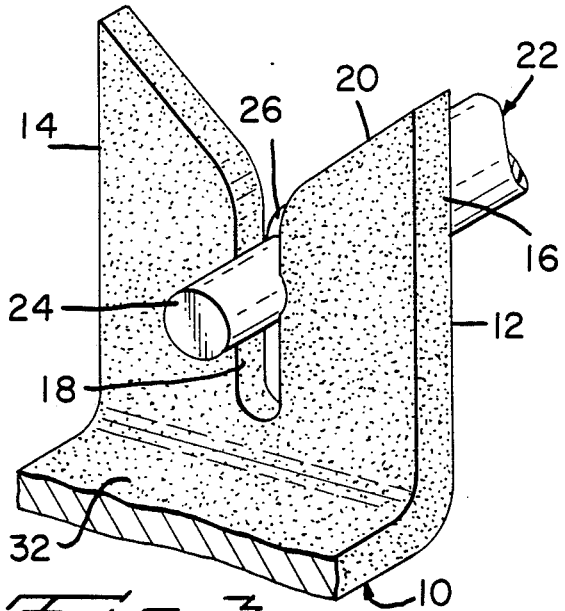
FIG. 3 is a perspective view of the structure FIG. 1 after the wire has been inserted.
Figure 4:
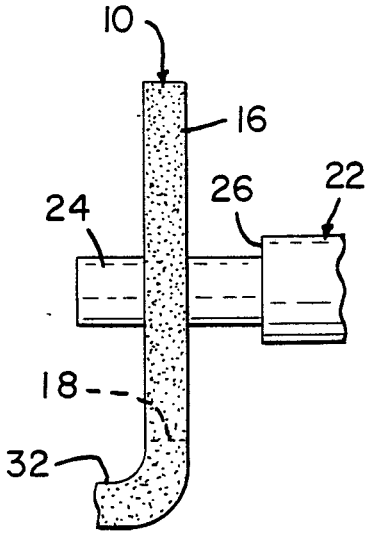
FIG. 4 is a side elevation of FIG. 3.

The terminal slotted plate portion 12 is intended to represent the conductor engaging portion of an electrical terminal 10 which is stamped and formed of conductive metallic sheet stock having spring properties such as brass, phosphor bronze, or beryllium copper. To give an appreciation of the relative sizes of things the wire 22 can represent a AWG table wherein the diameter of the conductor 24 is roughly 0.010 thousands of an inch with the outer diameter of the insulation 26 being 0.020 thousands of an inch. Slotted plate structures like that shown in FIG. 1 include a height H which is sufficient to define a slot S of depth SD allowing for the insertion of the conductor 22 as indicated in FIGS. 2, 3, and 4 with the conductor 22 being scrubbed by insertion in the slot S as it travels there along. The width dimension of the slot SW can be considered in the range between 40% to 80% of the diameter of the conductor 22. The beveled entry area at the top of plate portion 12 is rendered at an angle $\theta$ which is intended to guide or center insertion of the wire 22 so that the connector 24 ends up in the slot 18 without being cut off or unduly deformed or pinched.

FIG. 2 shows in side elevation, partially in section a typical installation tool 28 which contains a slot 30 which fits over plate portion 12 and is arranged to press the wire 22 down into the slot 18, as shown in FIGS. 3 and 4.

Figure 4A:
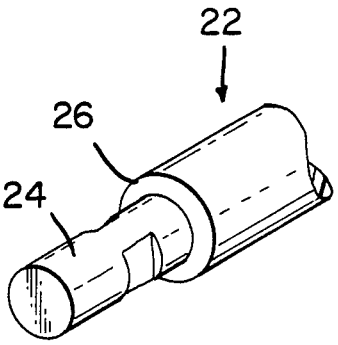
FIG. 4A is a perspective view of a wire which had been inserted and withdrawn to show deformation caused by the slot.

In accordance with IDC procedures the length of the slot SD in such that the conductor 24 can be moved there along for between $1\frac{1}{2}$ to $2\frac{1}{2}$ times the diameter 24 without bottoming the slot 18 so as to be unduly pinched or deformed and yet to get a good scrubbing and wiping action to remove, in the case of the embodiment heretofore discussed, oxide films on the conductor 24 by a mashing and inelastic deformation of the bulk of the conductor smearing, spearing and deforming the tin coating thereon and generally scrubbing the surfaces thereof along with the inner surfaces of the slot 18. FIG. 4A shows a kind of permanent deformation of conductor 24 which results from proper proportioning of the width SW of the slot 18 relative to the diameter of the conductor 24.

Thus far the disclosure heretofore given follows the general teachings of IDC practice outline in the previously cited publication concerning IDC. There is a distinction, however, with respect to the present invention relative to the thinking behind insulation displacement and its lies with the desired spring characteristics for IDC relative to the structure of the present invention. With IDC concepts the structure of plate 12 is designed to have dimensions H, T and SW such that when a conductor 24 is stuffed or forced into the slot 18, the plate 12 is elastically deformed transversally to the slot 18 to store energy and maintain a forceful engagement with the conductor 24 and the surfaces of slot 18 throughout the life of the resulting connection. What this means is that there was sufficient stored energy to accommodate the inelastic creep that results. If the plate 12 were perfectly rigid and gave not at all there would be no reserve energy and no follow up displacement to maintain the engagement with the wire or conductor 24, other than that within the conductor 24 itself which, because of its dimensions, is relatively less than could be stored in the plate 12.

With respect to the present invention, the purpose of the slot 18 and plate 12 is to strip away insulation 26 or oxide films, to rub and scrub the relative engaging surfaces of conductor 24 and slot 18, and to fixture the conductor 24 within slot 18 in a firm manner. In the present invention, stored energy and displacement force from plate 12 to conductor 24 and the surfaces thereof is not only not necessary, but should be limited where possible and practical. The reason for this is that the present invention relates to a solder or eutectic joint and stored energy, once this is accomplished, can only create stresses which are undesirable. Of course, as part of the invention, it is necessary to have insulation displacement and wire deformation for oxide removal, scrubbing and cleaning of the slot and conductor surfaces and fixturing, plus adequate engagement for heat transfer and reflow. All of these mean than there must be some deformation and both elastic and inelastic deformation of not only the conductor 24, but of the plate 12. The point is that where IDC needs a structure which generates an appreciable residual spring force to follow through with creep, the basis of slotted beam structure, in the present invention and the interface perfected by practice in the present invention a more rigid structure is desired. Generally this can be accomplished by making H less, T greater and using harder material than with normal IDC practice.

Referring again to FIGS. 1 through 4A, one will see that there is a coating 32, which represents a solder or eutectic coating, on at least the plate portion 12 of the terminal 10. This coating may be effected in a number of ways, preferably by electro plating in a manner to keeping slot 18 clear, or reasonable clear, and the edges that define the slot sufficiently sharp to do the job of oxide and insulation film or covering displacement. The coating 32 is shown in FIGS. 1–4 as covering the entire surface of plate portion 12 and in practice this has been done with respect to various samples. In an actual example the structure shown in FIGS. 1–4A had the following dimensions:

H=0.060–0.065 inches
T=0.010 inches
W=0.057 inches
SW=0.010 inches
SD=0.045 inches
Coating=0.001" of 63/37 tin lead eutectic
$\theta$=40°
Flux used—Superior Flux & Mfg. Co.—No30
Conductor diameter=0.013 inches In this example the material of the terminal 10 was BeCu 145, $\frac{1}{4}$ hard. It was prepared by cleaning using standard electro plating practices and the plating applied was a 63/37 tin lead eutectic having a liquid temperature of 361° F., with no pasty range. With the foregoing dimensions a coating 32 of 0.001 inches in thickness was found to be sufficient to effect the job of soldering the conductor 22 to terminal 10. Coating of thicknesses of 0.002 and 0.003 inches were also utilized with good results. The coating of 0.001 inches was found to be enough and the coating 0.003 inches was found to be not too much. Electro deposited tin lead eutectic of 90/10 type having a 361° F.–421° F. range were also tried with adequate results, but the 63/37 eutectic is preferred.

It is worth noting that the invention contemplates application of eutectics and solder coatings 32 which may not extend over the entire surface of terminal 10, but may be selectively applied as by masking. It is also contemplated that eutectics may be applied by laminating, molten dipping, printing, silkscreening, plating, spraying, inlaying, mechanical attachment or the like. Those skilled in the art will also appreciate that it is preferable to apply the solder after forming the terminals as normal tin lead solder will rapidly dull dies.

Figure 5:
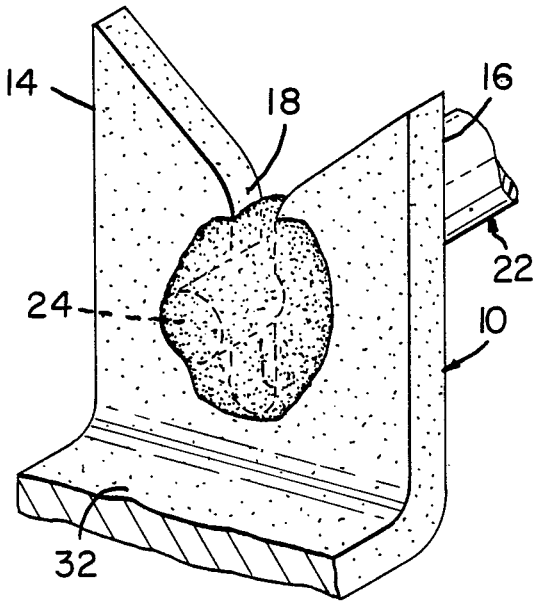
FIG. 5 is a perspective view, similar to FIG. 3 after solder reflow.
Figure 6:
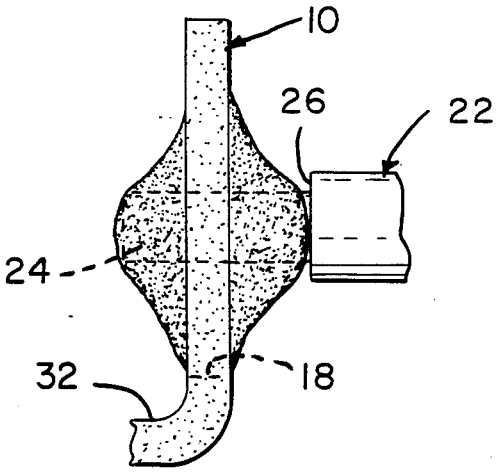
FIG. 6 is a side elevation, similar to FIG. 4, after solder reflow.
Figure 7:
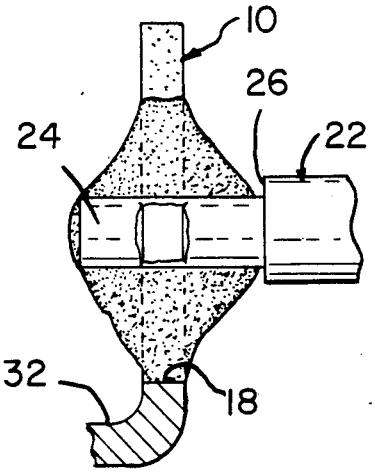
FIG. 7 is a vertical section through the terminal of FIG. 6.

Turning now FIGS. 5 through 7, the terminal of FIGS. 1 through 4A is shown after application of heat to cause reflow. In FIG. 5 the heat has caused the coating 32 to melt and concentrate around slot 18 and the conductor 24 of wire 22. One can see this particularly in FIGS. 6 and 7. A number of explanations have been made for why this flow of solder to the site of engagement of the conductor and slot occurs. Capillary, meniscus, surface tension are terms that have been used to describe this phenomenon. Suffice to say it does happen and it happens regardless of the attitude of the wire 22 and terminal 10 or the influence of gravity to result in a reliable and excellent electrical and mechanical termination of the conductor 24 to the terminal 10.

While the terminations shown in FIGS. 1 to 9 have been with stripped wire, it should be quite clear to those skilled in the art that the present invention is equally applicable to insulated wire which requires the terminal to pierce or displace the insulation to effect termination.

In actual examples, where the liquid temperature of the coating 32 was approximately 361° F., sufficient heat was applied to result in the soldering action in a number of different ways. For example, in one example a jet of hot nitrogen was used to effect the solder reflow. It is contemplated that hot oil, having a temperature will in excess of the phasing temperature of the eutectic, may also be employed. Alternately, resistance heating, infrared, laser and as will be described in detail hereinafter, a type of eddy current heating resulting from the focusing of electromagnetic alternating fields may be used.

Figure 8:
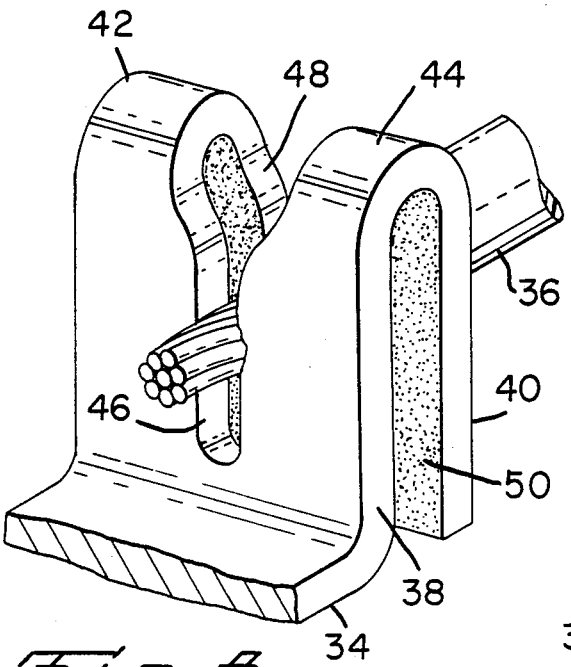
FIG. 8 is a perspective view of an alternate terminal structure terminating stranded wire.
Figure 9:
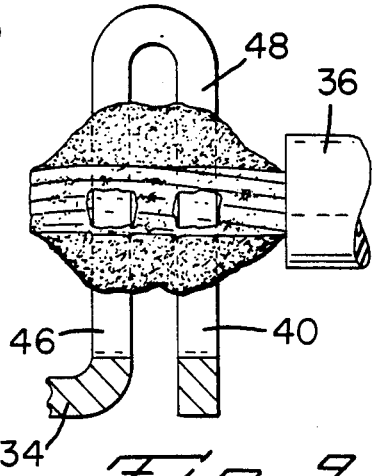
FIG. 9 is a vertical section through the terminal of FIG. 8.
Figure 10:
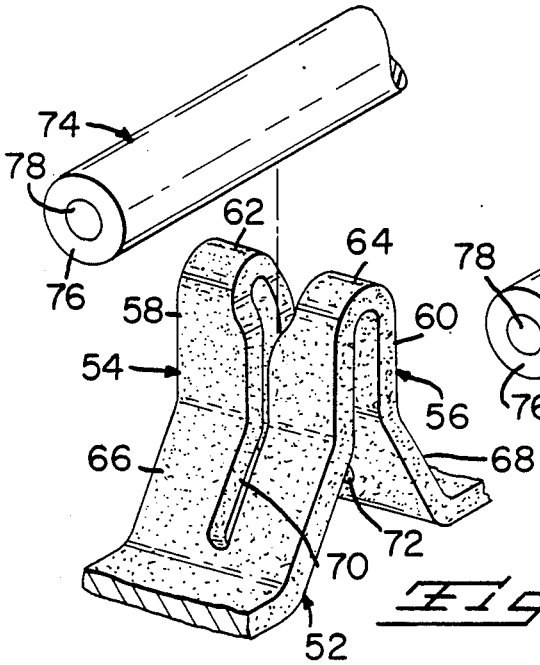
FIG. 10 is a perspective view of another alternate structure with an insulated wire exploded therefrom.
Figure 11:
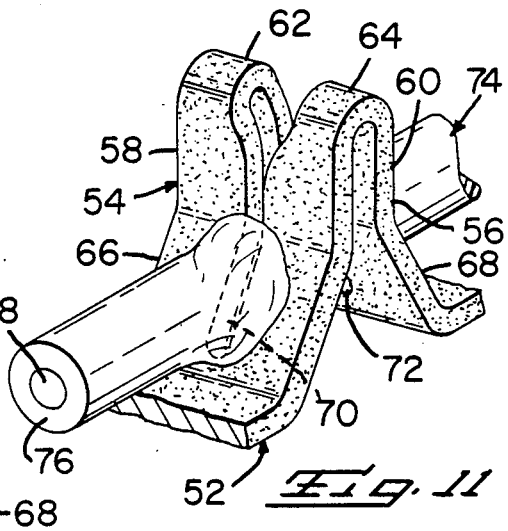
FIG. 11 is a perspective view, similar to FIG. 10, with the wire fully inserted.

FIGS. 8 and 9 show an alternate terminal 34 terminating a stranded wire 36 applied in accordance with the invention. This terminal has a folded slotted plate portion similar to that described in U.S. Pat. No. 4,261,624, the disclosure of which is incorporated herein by reference. It has been found that the invention is particularly useful with respect to pre-tinned stranded wire. Referring back to FIG. 1, the reason is that in many of the commercial IDC structures which have been used over the years the practical thickness W of the plate portion 12 is thin enough to cut strands when taken with the width SW of the slot necessary to get stored energy of the application of stranded wire to IDC. Alternatively, the slot width SW and the thickness T have been designed to cut through or break through insulation resulting in a structure which tends to cut stranded conductors. This is particularly true with respect to multiple wire termination where the placement of the wire is less than in the application of one wire into one slotted plate. FIG. 9 shows that the solder coating will reflow filling the void between the folded plates of this embodiment while securing the stranded wire therein.

With respect to the single plate slotted beam configuration of FIGS. 1 to 7, practice of the present invention and manufacture thereof is relatively straightforward. The terminal embodiments shown in FIGS. 8 to 14 are three alternates or variations of the invention wherein the termination portion is made to receive an insulated wire having a conductor surrounded by insulation. In each embodiment the slotted plate portion is folded over to include U-shaped portion.

The embodiment of FIGS. 8 and 9 provides a redundancy of interface formed by a pair of plates 38, 40 connected by bights 42, 44, each plate defining a slot 46, 48, a much larger interface and allows for a different type of application of the coating. In the embodiment of FIGS. 8 and 9 the solder coating 50 can be applied only to the inside region between the plates 38, 40. With respect to this alternative, the coating 50 can be pre-applied as a stripe, or stripes, by either selective electroplating or inlaying of a solder pre-form roughly 0.001 inches thick. The bights of this embodiment are closed tightly so that reflow tends to wick between the interior surfaces.

Inclusion of a fairly thick film or covering of insulation does not appreciably interfere with the operation of the invention wherein the reflowing solder tends to flow in around the wire and slot to effect termination. An ultimate test is to pull wire 22, 36 in tension until it breaks. If that break occurs away from terminal 10, 34 the connection is, in essence, stronger than the wire—a desirable result.

Figure 12:
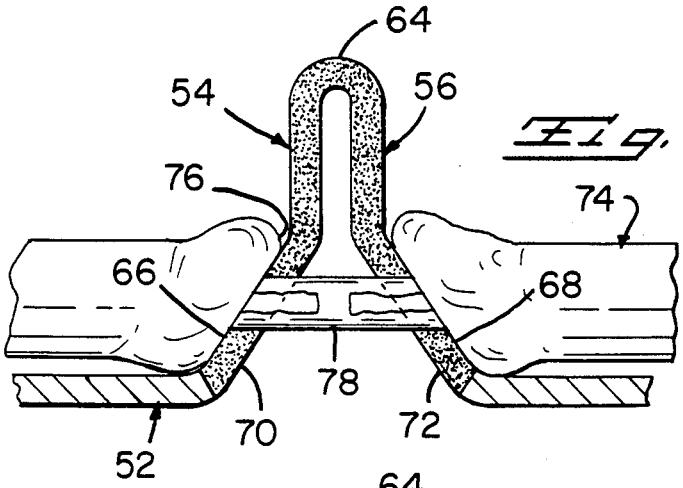
FIG. 12 is a side elevation, partially in section, of the terminal of FIG. 11.
Figure 13:
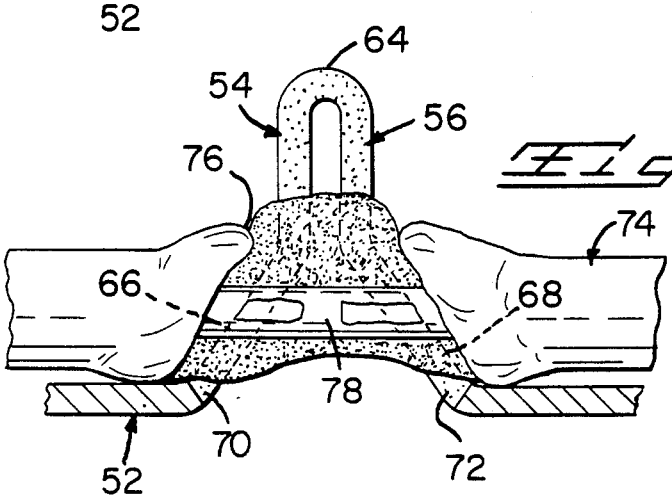
FIG. 13 is a side elevation, similar to FIG. 12, showing the termination after solder reflow.

FIGS. 10 to 13 show a further embodiment of the present invention wherein the terminal 52 includes a folded over plate similar to the embodiment of FIGS. 8 and 9. In this embodiment the plates 54, 56 have upper portions 58, 60 connected by bights 62, 64 and doubled over and lower portions 66, 68 which are spaced apart. The plates 54, 56 include slots 70, 72. This embodiment is intended to be used with insulation which is either relatively thick, has heat insulating characteristics, or is of a quality which is readily split. As the wire 74 is inserted, its insulation 76 will be split by the slots 70, 72 in the upper portions 58, 60 of the plates 54, 56 to then be actually pulled apart, as shown in FIG. 12, as the bare conductor 78 is driven into down the slots 70, 72. The insulation 76 can be seen totally separated in FIGS. 12 and 13. These figures also show the skiving action of the slots 70, 72 on conductor 78. It should also be noted, from FIG. 13, that the insulation 76 can be pulled back by the heat of the reflow operation and/or pushed back by the reflowed solder.

Figure 14:
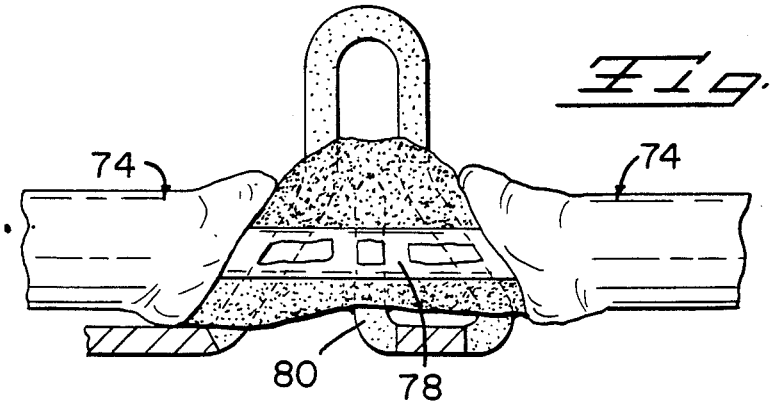
FIG. 14 is a side elevation, similar to FIG. 13, of another alternate embodiment of a terminal incorporating the present invention.

FIG. 14 shows a further modification of the terminal of FIGS. 10 to 13 to include a separate slotted blade portion 80 intended to be the principle electrical interface with the conductor 78 forced therein. Here again this embodiment is intended for especially thick insulations requiring substantial strength in the terminal.

Figure 15:
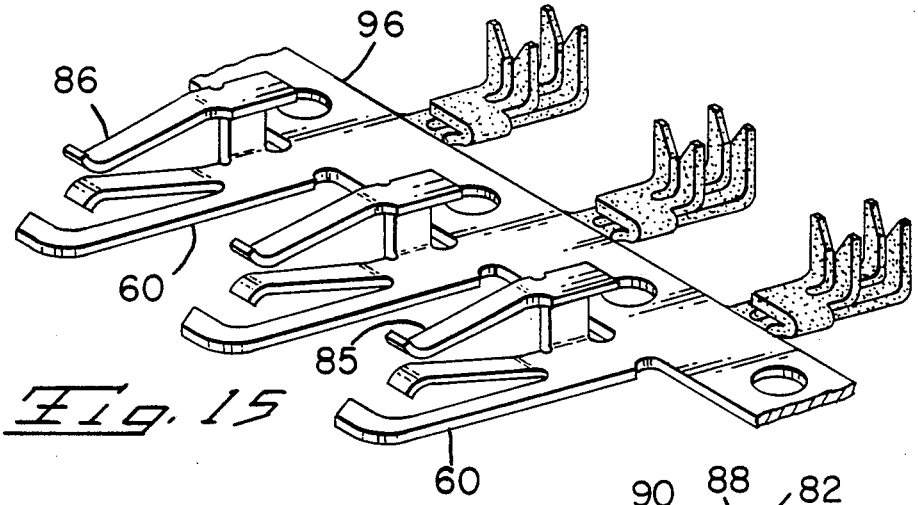
FIG. 15 is a perspective view of a strip of terminals formed to utilize the present invention.
Figure 16:
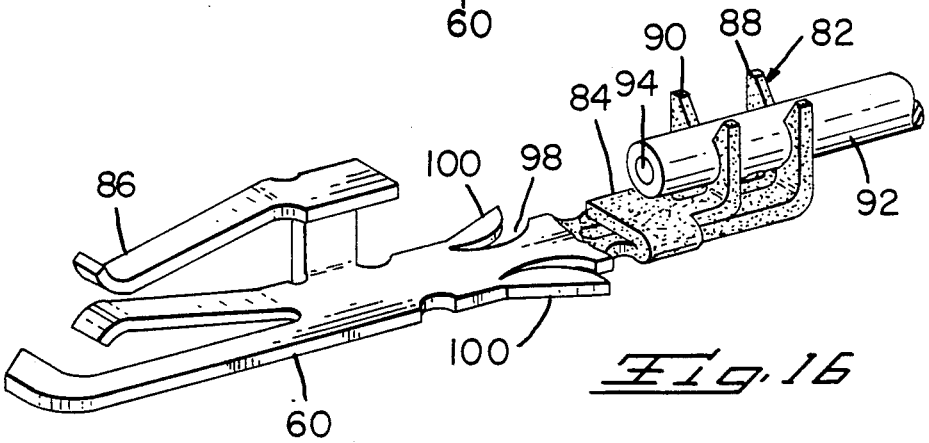
FIG. 16 is a perspective view of a single terminal from the strip of FIG. 15.

FIGS. 15 and 16 show a strip of electrical terminals and a single terminal, respectively, stamped and formed to include a terminating portion 82 having dual slotted plates for redundancy and suitably coated with solder 84 and front-end contact spring fingers 86 intended to mate with conductive portions of like terminals. This terminal is of the type described in the previously mentioned U.S. Pat. No. 4,040,704. The terminating 82 includes slotted plates 88, 90 which are turned at right angles to the insertion axis of the wire 92 which tends to load the spring elements of the slotted plates in torsion giving a different clamping or fixing action relative to stripping and fixturing of the conductor 94 of the wire 92. In addition, it will be noted when the individual terminals are separated from the corner strip 96 a region 98 of reduced metallic cost sectional area is formed wherein terminal locking spring elements 100 have been struck-out from the plane of the metal. This region can be controlled in width to sharply limit the transfer of heat from the region of the slotted plates 88, 90 to the region of the spring fingers 86 to prevent annealing of the contact spring fingers. The bulk of the metal in the region of 98 need only be thick enough to be structurally adequate to hold the terminal together in use and, depending upon the thermal conductivity of the metal, adequate to carry current without excessive resistance.

Figure 17:
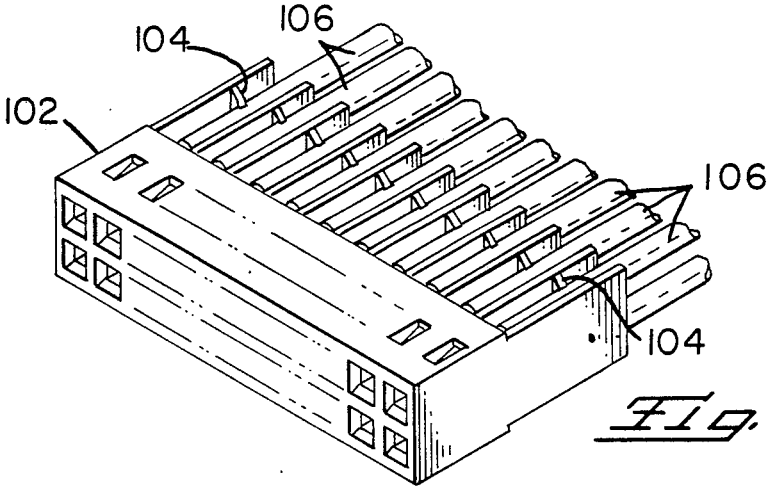
FIG. 17 is a perspective view of a connector of a type suitable for use with the present invention.
Figure 18:
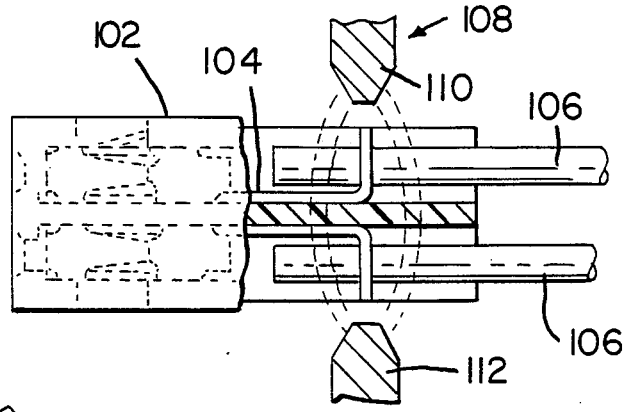
FIG. 18 is a side elevation, partially in section, of the connector of FIG. 17 in an electromagnetic heating device to effect solder reflow.
Figure 19:
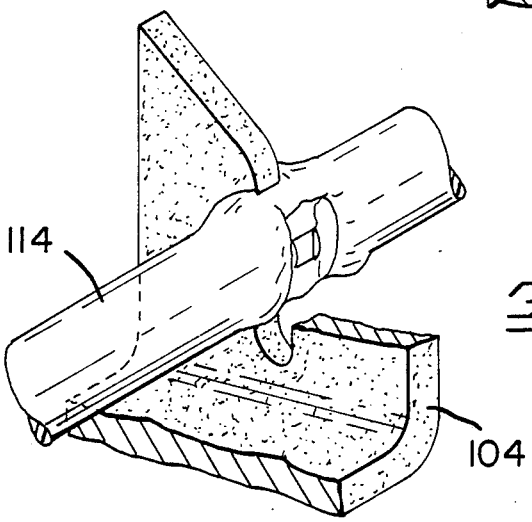
FIG. 19 is a perspective, partially broken away, of a terminal and inserted wire prior to solder reflow.

FIG. 17 is a perspective view of a representative electrical connector 102 containing numerous terminals 104 terminating a like number of wires 106. FIG. 18 shows the connector 102 proximate to a tool 108 which has ferrite magnetic pole pieces 110, 112 shaped to concentrate an electromagnetic field in the region of termination of the connector terminals 104 to the wires 106. Regarding tool 108, reference is made to U.S. Pat. No. 4,359,620 dated Nov. 16, 1982, to Joseph R. Keller which shows an induction heating apparatus having shaped ferrite pole pieces which focus or concentrate a field of high flux density. An alternating field is produced, indicated by the broken lines between pole pieces 110, 112, which results in Eddy Current generation in the wire 106 and heating of the metal conductor thereof. The surrounding plastic housing of connector 102 and the wire insulation are not affected by the field, while the focus of the field concentrated in the termination zone creates intense heating of the conductor metal and solder.

Figure 20:
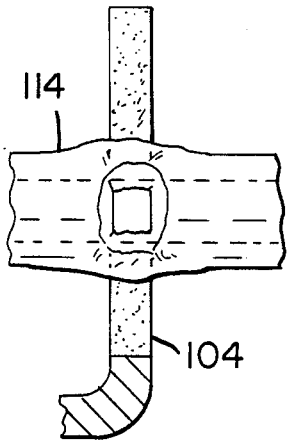
FIG. 20 is a vertical section through the terminal of FIG. 19.
Figure 21:
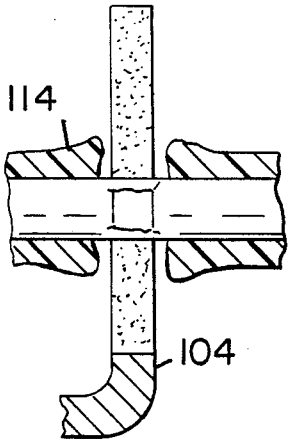
FIG. 21 is a vertical section, similar to FIG. 20, early in the cycle of heating for solder reflow.
Figure 22:
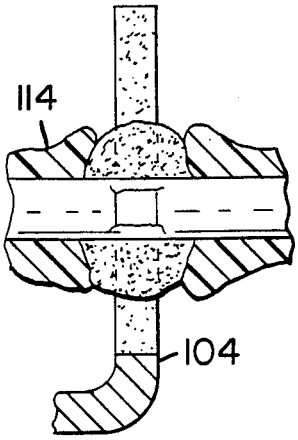
FIG. 22 is a vertical section, similar to FIGS. 20 and 21, at the completion of solder reflow.

FIGS. 20 to 22 show the effect of heat generation by the eddy current. In FIG. 20, prior to heat generation, a termination slot of a terminal 104 is shown in section with conductor 106 in the slot and its insulation 114 split, as frequently happens with the PVC, polypropylene, or polyethylene insulation in wide use in industry. FIG. 21 shows the resulting melt and pull back of insulation 106 before reflow of the solder coating on the terminal 104.

FIG. 22 shows the terminal 104 after reflow, with the insulation pulled away, and the solder joint formed. This insulation pull back happens best with eddy current heating where the heat comes from the terminal 104, rather than from an external source, such as with hot nitrogen, vapor phase, resistance or infrared heating which tend to "cook" from the outside surfaces rather than generate heat in the surfaces of the metal parts.

FIG. 18 also shows the connector 102 with wires terminated. Essentially no damage is done to the housing 102 if the application of heat is quick. With the abovementioned Keller induction heating system, focused alternating electromagnetic field cycle times of a few seconds are possible. In general this time cycle is a function of the focus of field, the frequency of alternation and the properties of the material to be heated. As taught in Keller, frequencies of between 20 and 200 Khz have been tried using the Keller unit and apparatus. The eddy current heating approach is a preferred way when using connector housings pre-loaded with many terminals. Commercial induction machines with special coils may also be employed, as other means discussed, with results varying from barely adequate to excellent.

With regard to the practice of the invention, it will be appreciated that the structures heretofore described and shown assure that four of the five critical parameters for solder are "built in". The right solder is factory applied in construction and manufacture of the terminal for prescribed types of wire and cable. The slot and action of conductor insertion operate to assure cleaning action. The slot and plate structure assures the right fixturing to hold things still and promotes the right pressure of parts for heat transfer. By using eddy current heating from a machine with fixed pole pieces, which precisely focus the magnetic field and an appropriate timing current, the fifth parameter of right amounts of heat can also be assured.

The phenomena of solder flow to the site of conductor slot interface and the pull back of insulation by virtue of heating occur over a fairly broad range of application parameters, nevertheless and these discoveries are deemed significant to the practice and advantage of the invention.

It should be noted that FIGS. 20 to 22 represent almost a classic case for effecting termination with the present invention. In most instances where the wire is not prestripped, the insulation is cut only on both sides and may remain intact above and below the conductor. This usually, but not always, will separate during the heating cycle.

Any of a number of fluxes can be used with the present invention. For example, a water soluble flux could be applied immediately before reflow. If it were also electrically nonconductive and noncorrosive, it could simply be washed away after reflow. It would also be possible to precoat the terminals with an oxidizing inhibitor which would act as a cleaning agent.

We claim:

1. A method of terminating insulated electrical conductors in terminals having terminating sections including slots in an electrical connector having a plastic housing, characterized by the steps of:

applying solder on the terminals in the terminating section along the slots;

positioning the terminals in the plastic housing;

positioning the electrical conductors at the entrance to the slots of said terminals in said plastic housing;

driving the conductors into the slots of said terminals in said plastic housing, so that the conductor is in frictional engagement with the terminating section forming an electrical connector therebetween; and reflowing the solder which gathers at the connection formed between the conductor and the terminating section of said terminals in said plastic housing, by positioning portions of the plastic housing adjacent the terminating section of said terminals in an electromagnetic field to concentrate the electromagnetic field on the terminating section.

* * * * *

UNITED STATES PATENT OFFICE

CERTIFICATE OF CORRECTION

Patent No. 4,926,548 Dated May 22, 1990

Inventor(s) John R. Hopkins, Randy M. Manning, Stephen A. Marusak

It is certified that error appears in the above-identified patent and that said Letters Patent is hereby corrected as shown below:

ON TITLE PAGE:
In the title after the word "METHOD" add --AND PRODUCT--.

Signed and Sealed this

Eleventh Day of February, 1992

*Attest:*

HARRY F. MANBECK, JR.

*Attesting Officer*

*Commissioner of Patents and Trademarks*